US006167975B1

(12) United States Patent
Estes

(10) Patent No.: US 6,167,975 B1
(45) Date of Patent: Jan. 2, 2001

(54) ONE CONE ROTARY DRILL BIT FEATURING ENHANCED GROOVES

(75) Inventor: Roy Dee Estes, Fort Worth, TX (US)

(73) Assignee: Rock Bit International, Inc., Fort Worth, TX (US)

( * ) Notice: Under 35 U.S.C. 154(b), the term of this patent shall be extended for 0 days.

(21) Appl. No.: 09/282,950

(22) Filed: Apr. 1, 1999

(51) Int. Cl.[7] ..... E21B 10/08
(52) U.S. Cl. ..... 175/331; 175/336; 175/376
(58) Field of Search ..... 175/336, 365, 175/367, 376, 343, 331, 339, 340

(56) References Cited

U.S. PATENT DOCUMENTS

| | | | | |
|---|---|---|---|---|
| 1,859,948 | | 5/1932 | Zublin . | |
| 2,025,261 | | 12/1935 | Zublin . | |
| 2,065,436 | * | 12/1936 | Ervin | 175/363 |
| 2,207,188 | | 7/1940 | Zublin . | |
| 3,424,258 | * | 1/1969 | Nakayama | 175/376 |
| 4,549,614 | | 10/1985 | Kaalstad et al. | 175/339 |
| 4,624,329 | * | 11/1986 | Evans et al. | 175/331 |
| 4,790,397 | | 12/1988 | Kaalstad et al. | 175/365 |
| 4,832,143 | | 5/1989 | Kaalstad et al. | 175/365 |
| 4,936,398 | | 6/1990 | Auty et al. | 175/336 |

* cited by examiner

*Primary Examiner*—William Neuder
(74) *Attorney, Agent, or Firm*—Felsman, Bradley, Vaden, Gunter & Dillon, LLP

(57) ABSTRACT

A one cone drill bit is equipped with multiple jet flow guiding grooves along the cone. The multiple grooves connects to a circular groove axially centered on the nose end portion of the cone. The circular groove sweep the cuttings and mud flow across the drilled face and up the well borehole.

24 Claims, 3 Drawing Sheets

ONE CONE ROTARY DRILL BIT FEATURING ENHANCED GROOVES

BACKGROUND OF THE DISCLOSURE

It is commonplace to drill wells today with tricone drill bits. Tricone drill bits represent the industry standard and have done so since their advent about 75 years ago. The tricone drill bit has a number of advantages, and these advantages have prompted the domination of the business with tricone drill bits. To be sure, single cone drill bits existed many years ago and were somewhat common drill bits prior to the advent of the tricone drill bit. This disclosure, however, is directed to a single cone rotary drill bit which is especially useful in a number of circumstances today. With a tricone drill bit, a large diameter hole can be drilled. To mount all three of the cones and to make arrangements for the balanced support of the three cones and to provide relatively symmetrical loading on the threaded drill bit as it connects with the drill collar thereabove, the tricone drill bit, when drilling a large diameter hole, has many advantages. It is not uncommon, however, to drill extremely deep wells where the wells do have reductions in diameter.

Reductions in diameter from the surface can be achieved with tricone drill bits in a limited measure. Very large drill bits are used to form the first few hundred feet of a hole, and then the next step involves a large tricone drill bit, and then the next step involves a smaller tricone drill bit. Eventually, it is desirable to reduce the diameter of the hole even further. When a drill bit is reduced in diameter, typically below about six inches in diameter, certain size dictating limitations come into play, thereby reducing the life of the tricone drill bit. Such wells (sometimes known as a slim hole) are often now drilled with a mud motor. Even when drilled with the rotary equipment at the well head rather than a mud motor, there is a common limitation which relates to the bearings. In general terms, because of crowding in a small tricone drill bit, the three cones are supported on bearing assemblies which are relatively small. Because they are so small, bearing life is shortened. A tricone drill bit of large diameter equipped with large diameter bearings will last much longer. One advantage of the single cone drill bit in this disclosure is that a very large diameter bearing is installed even though the drilled hole is relatively small, and relative bearing speed is also reduced, extending the life of the bearing assembly.

Every drill bit has an estimated life. Sometimes, the driller can just place his hand on the rig floor equipment and guess by the surface located vibration or chatter whether or not the bearings in the drill bit are failing, and hence initiate a trip to remove the drill bit, replace the drill bit, and reenter the well. This is an experience factor which is commonly encountered with the tricone drill bit. It has a notable way of chattering or forming a constant repetitious noise and vibration signal at the surface sensed by skilled and experienced personnel. In part, this results from the fact that one bearing assembly on one cone will fail first and yet the bit will continue to operate, limping along with more vibration. Since that can be detected at the surface, another trip is initiated to replace that drill bit. The smaller the bits the more difficult it is to recognize symptoms of failure. The good news in a slim hole single cone bit is that it has a very large bearing and the simple cone rotates much slower than a cone on a similar size tricone bit rotating at the same RPM. When it runs slower, the velocity inflicted on the bearing assembly is slower. When that occurs, the single cone drill bit will simply last longer. The single cone drill bit of this disclosure can last longer even when driven by mud motor. Typically, a rotary table turns somewhere between 60 and 120 rpm. Where a mud motor is used, the mud motor will rotate the drill bit at perhaps 200 rpm. Even 300 rpm is sometimes achieved. As the speed is picked up, bearing failure occurs sooner.

Bit life has been extending by the drill bit of the present disclosure. It operates longer and it will operate at a greater rpm. This is because of the installation of a much larger and stronger bearing assembly in the single cone drill bit and the fact that the cone in this bit rotates slower than the three cones in a tricone drill. With a single large bearing assembly, life is measurably extended.

One aspect of the present disclosure is the incorporation of a sealed, pressure compensated journal bearing mounted on a journal having a journal angle of less than about 45°. The journal supports a cone which in turn is equipped with an appropriate cutting structure. The preferred form is a set of tungsten carbide (WC) inserts. These inserts are known below as TCI. The single cone has a novel set of fluid channel grooves on the cone aligning with the jet nozzles. The single cone has a nose area with a circular groove which improves cutting face flushing.

SUMMARY OF THE INVENTION

It is the object of this invention to provide an improved one cone rotary TCI rock bit having enhanced performance due to better cuttings removal. This invention provides a radial groove on the nose end of the cone which connects three spiraling axial grooves. This novel series of connected grooves provides a more efficient flow path for fluid directed to the hole bottom. Less resistance on the return path allows the fluid to circulate faster under the bit and remove the cuttings faster. It is important to remove cuttings quickly to prevent re-grinding the cuttings. In some formations, better removal of the cuttings will also help prevent bit balling. The single cone has a set of nose located bearing inserts.

BRIEF DESCRIPTION OF THE DRAWINGS

So that the manner in which the above recited features, advantages and objects of the present invention are attained can be understood in detail, more particular description of the invention, briefly summarized above, may be had by reference to the embodiments thereof which are illustrated in the appended drawings.

It is to be noted, however, that the appended drawings illustrate only typical embodiments of the invention and are therefore not to be considered limiting of its scope, for the invention may admit to other equally effective embodiments.

DETAILED DESCRIPTION OF THE PREFERRED EMBODIMENT

Figure 1:
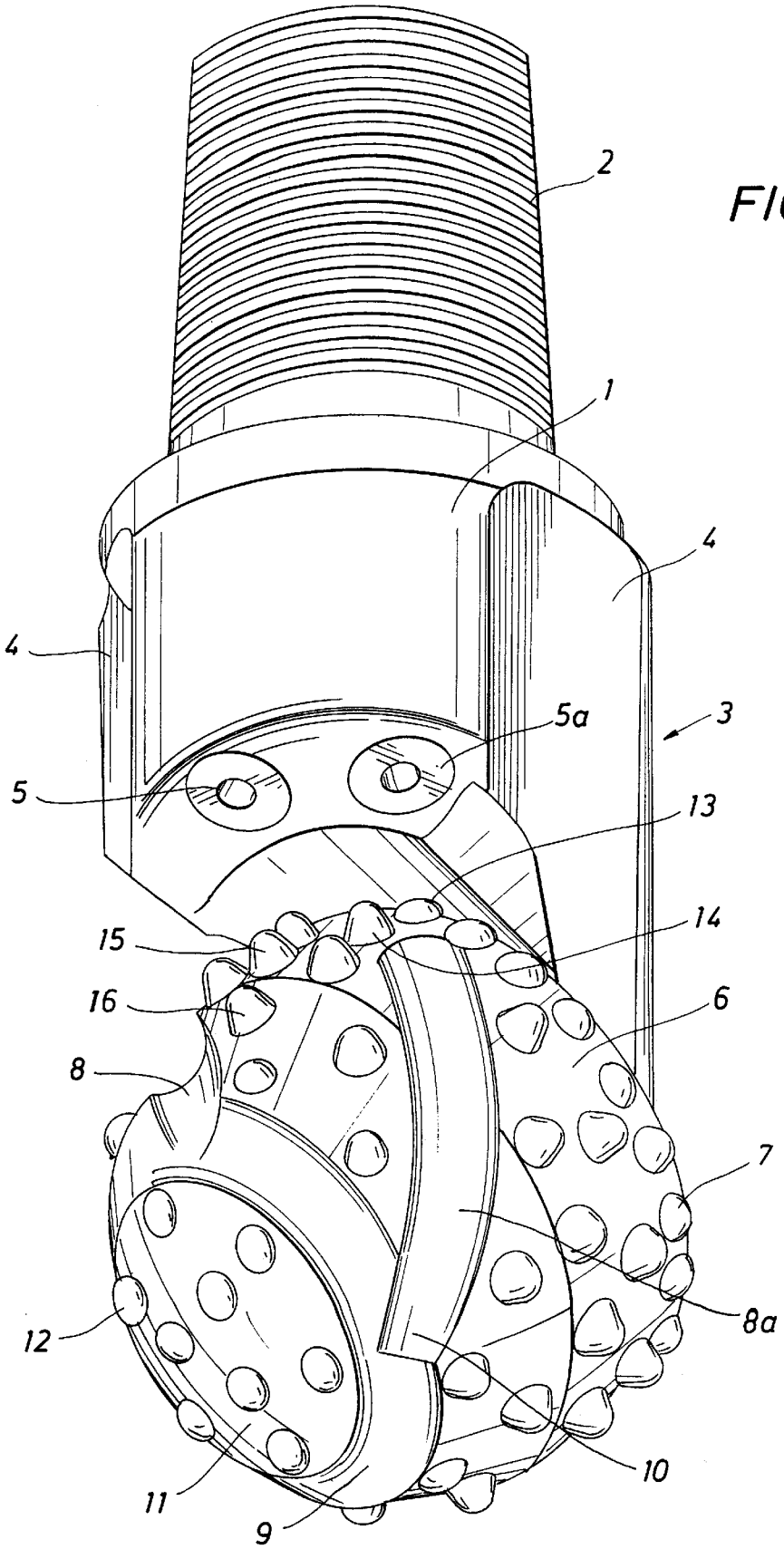
FIG. 1 is a view of a one cone bit showing a preferred embodiment.

Referring to FIG. 1, the drill bit 1 has a threaded section 2 on its upper end for threading to a drill string or mud motor (not shown) for rotation. The elongate body 3 has one or more vertically extending junk slots 4 to reduce the resistance to drilling fluid and enable cuttings to flow up the borehole. The body 3 has fluid nozzles 5 for directing drilling fluid downward and toward the leading edge of the single cone 6. The cone 6 is rotatably mounted on a journal depending downward and inward from the lower end of body 3. This drill bit 1 has a bearing component, cone/journal seal and a pressure compensating lubrication system. These components can vary widely in design and the specific type of components is not critical to the bearing function of this invention. A representative system is shown in sectional view in FIG. 3. Bits of this type are sometimes run with the fluid nozzles 5 of larger diameter to reduce back pressure against a mud motor. There can also be fluid nozzles pointing upward and outward (not shown) for the purpose of reducing back pressure against a mud motor. The cone 6 has a set of cutters arranged in several radial rows of tungsten carbide inserts 7 for scraping and crushing earth formations. The inserts 7 vary widely in shape, size, hardness and quantity depending on type of earth formations a given bit is designed to drill. The inserts 7 are not limited to tungsten carbide only. The cone 6 has three axially spiraling grooves 8 for channeling fluid to the borehole bottom where the cuttings are formed. The grooves 8 are not equally spaced around the cone 6. Unequal spacing of the grooves 8 minimizes the risk of insert tracking. The grooves 8 are oriented such that, as the cone 6 rotates, the grooves 8 are periodically aligned with the jetting flow of fluid from one or more of the nozzles 5 as the grooves 8 pass the leading edge area. In FIG. 1 the groove 8*a* is in the position just described. Note that fluid from the nozzle 5*a* is directed down the length of groove 8*a* toward the bottom of the borehole. A radial groove 9 encircles the nose end 10 where all of the grooves 8 converge. The groove 9 provides an outlet channel for fluid that flows down the grooves 8. This allows the fluid to travel faster across the hole bottom removing cuttings faster and more efficiently. The groove 9 also allows removal of larger particles or cuttings.

It is another advantage of this invention that the nose area 11 of the single cone 6 is best utilized for bit stabilization. Prior art of record shows no one cone bit which directs fluid to the borehole bottom and utilizes the nose end of the cone at the same time. Those prior art bits that channel fluid through the center of the cones obviously lose the use of the nose area for anything else.

Dulled one cone bits (from 1994–1998) with nose inserts have shown substantial wear of the nose inserts. This confirms that the nose inserts 12 can be designed to be formation cutting inserts. One cone bits previously did not have inserts on the nose of the cones. The primary cutting rows of inserts are the outer rows labeled 13, 14, 15 and 16 on FIG. 1. The reactive force of these TCI inserts against the formation pushes the nose area 11 of the cone 6 against the borehole wall, see FIG. 3. As the nose inserts 12 wear down, the bit continues to move toward the nose area. This thrust pushes the bit toward an off centered axis that is not the designed axis of rotation.

Figure 2:
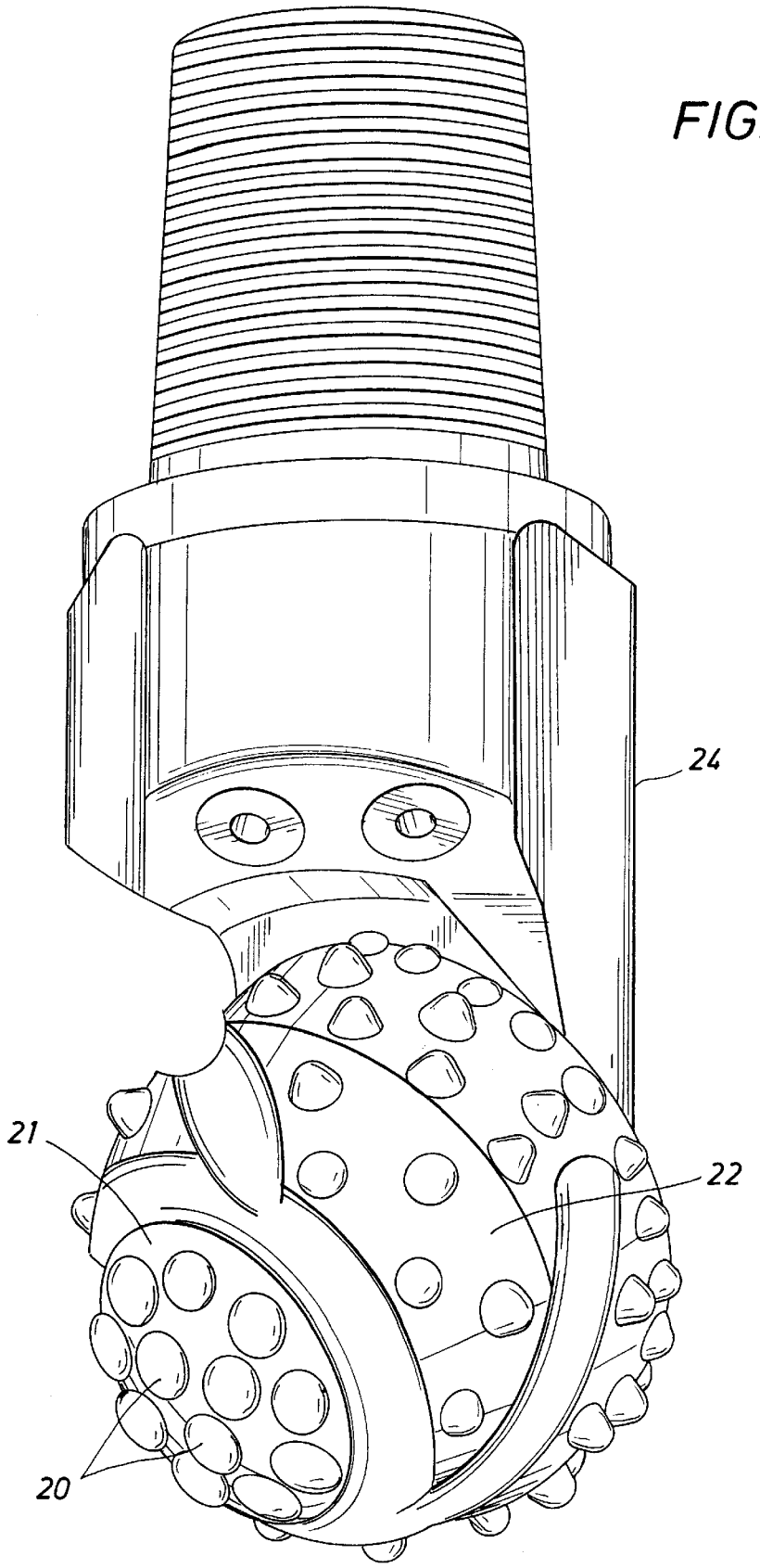
FIG. 2 is a view of a second one cone rock bit.

FIG. 2 shows a second embodiment of this invention which allows improved bottom hole cleaning and utilizes the nose area to help stabilize the bit center of rotation nearer the design center of rotation. In FIG. 2, the inserts 20 on the nose 21 of cone 22 are substantially larger and blunter than inserts previously used in this area. The nose area 21 of cone 22 is intended to stabilize the bit 24 rather than cut formation or protect the cone steel. The size, shape and quantity of inserts 20 provide a large amount of carbide (or other wear resistant material) that will resist wear much longer than anything in prior art.

Figure 3:
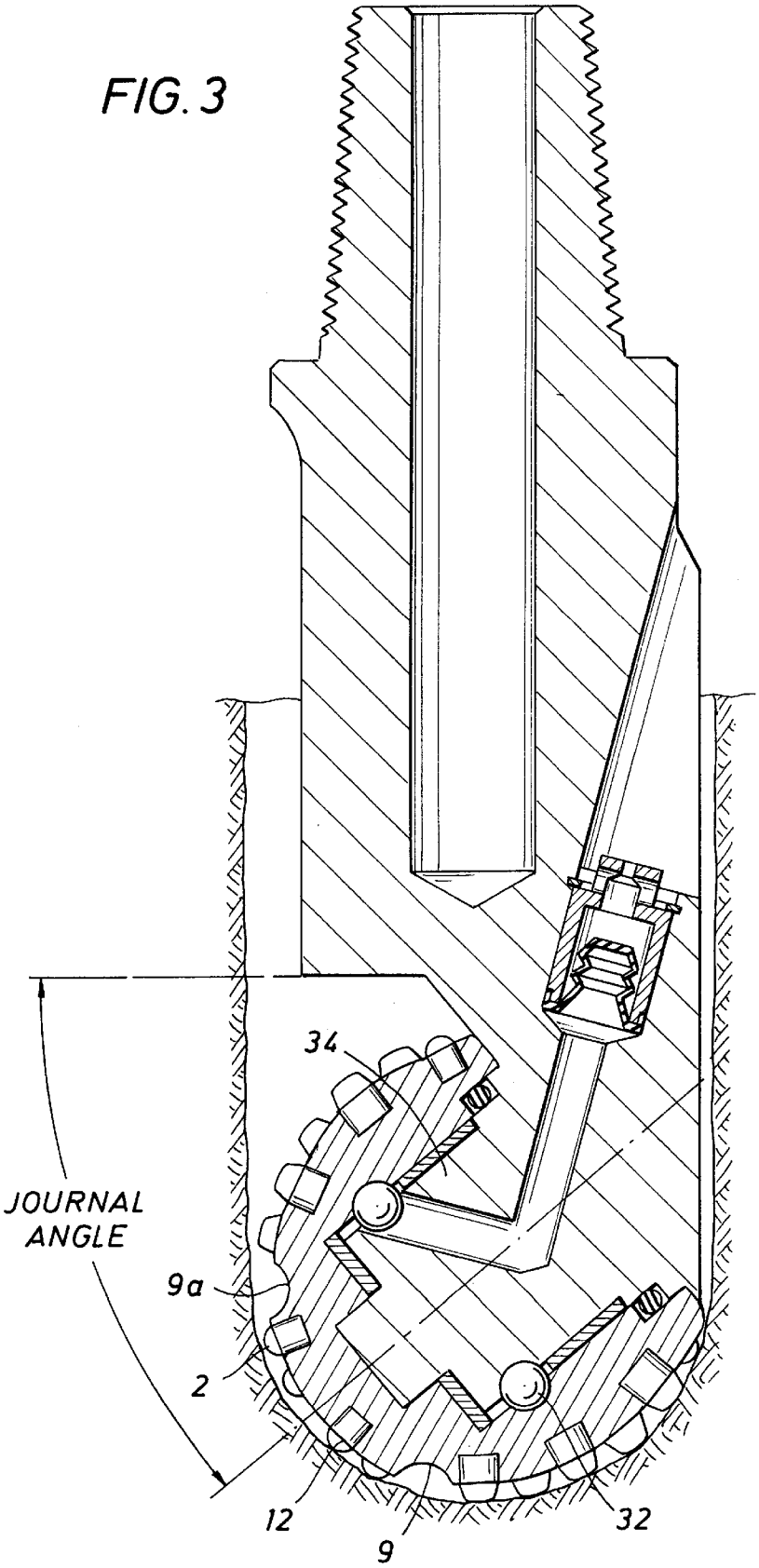
FIG. 3 is a sectional view through the journal and cone showing more details.

One important aspect of the present invention is the incorporation of the grooves 8 along the cone 6 connected to the groove 9. FIG. 3 shows this in better detail where the groove 9 is illustrated in cross section. Typically, there are at least two and the preferred number is three of the grooves 8. They all have a common curvature so that they are cut in the outer conic face of the cone to provide a more or less straight pathway below one of the jets 5 which introduce the straight flow of drilling fluid. The jetting action of the introduced flow is received into the grooves 8. FIG. 3 has been incorporated to show how the circular groove 9 cooperates. A third, and sometimes a fourth groove 8 as desired, are incorporated on the outer surface of the cone. The grooves 8 are included for the purpose of guiding the fluid flow to the face of the well borehole which is being drilled. The face being drilled is normally represented in theoretical fashion as a deeply concave face. The jet stream which is pumped at high velocity under high pressure from the emergent nozzle flows across that end face. The offset mounting of the jet 5 from the center line axis of the drill bit matches up with the grooves 8 so that each groove 8 has a rotation about the cone axis enabling the groove to line up with the jet pathway. So to speak, the jet stream flows across the end face because of the intervention of the cone. To this end, FIG. 1 shows an offset so that the jet nozzle 5 is not on the center line, but is cantilevered out from the center line axis. In actuality, one jet is all that is needed, but it is commonplace to include two or three jets to control back pressure. Some can be directed along any axis of flow desired. In this instance, the cone, smaller at the bottom, is positioned so that momentarily the sight line determined by the nozzle directs the flow where the cone is located, grazing the cone in a tangential fashion and guided by the groove 8.

Groove construction assures better flushing of the end face of the idealized well borehole. The face is flushed and cuttings are quickly removed from the area. This rotated position of the groove 8 as shown in FIG. 1 accomplishes this purpose. FIG. 3 also includes conveniently a bearing assembly 32 which is around a journal 34. The journal 34 is deployed from the fixed body 3 of the drill bit extending downwardly at an angle and crosses the center line axis of the well borehole (the centerline axis of the threaded upper body) so that the cone is positioned as illustrated. The journal 34 is located on this axis defined mounting and is inclined at an angle preferably in the range of about 30° to about 45°, and more preferably about 33° to 42°.

FIG. 3 of the drawings adds various details regarding the upper body 3. The groove 9 fully encircles the nose area 11. Going back to FIG. 2 of the drawings, the inserts 20 that are inside the circumference of radial groove are designed to function as a bearing surface(s) rather than a cutting structure. Therefore, the inserts are more in quantity, more blunt in shape and generally larger in diameter than the comparable inserts of FIG. 1. Polycrystalline diamond compact (PDC hereinafter) inserts are very suitable in this application. The aggregate insert face area is 200% or more than the area if the inserts were cutting inserts. The inserts are not equipped with cutting edges; rather they are blunt, and preferably polished PDC at the end. One advantage is that the inserts assist in cutter stabilization. Also, the inserts 20 lift up the cone so that the grooves 8 cooperatively send fluid to wash cuttings away. The jetting mud flows down, flushes into the groove 9 and carries away cuttings. They flow into the groove 9 and up at the left of FIG. 3. The groove portion 9*a* is part of the circular groove "leaking" mud up and away from the cutter cone 6. The groove 9 sweeps most of the face to clear the face of cuttings.

While the foregoing is directed to the preferred embodiment, the scope thereof is determined by the claims which follow.

What is claimed is:

1. A one cone drill bit comprising:

(a) a drill bit body having a threaded upper end for connection in a drill string;

(b) said drill bit body extending below the threaded upper end and having a passage therein for mud flow;

(c) at least one mud flow jet installed in said drill bit body and having an opening therein wherein the jet is positioned to direct a downwardly directed flow of drilling mud utilizing drilling mud which is pumped into a drill string connected to the drill bit and wherein the flow of drilling mud is confined against the face of the well borehole being drilled;

(d) a downwardly deployed portion on said body;

(e) a journal extending at an angle from said portion;

(f) a single cone mounted for rotation on said journal wherein said cone has a large upper end at the upper end of said journal and a smaller lower end with a central lower end nose area;

(g) a cone surface supporting one or more rows of cutting teeth bearing against the face of the well borehole for extending the well borehole during drilling;

(h) a groove formed on said cone nose area wherein said groove while rotating receives the jet of drilling mud from said jet and said groove cooperates to direct mud flow from the jet; and (i) wherein said groove defines a substantially clear pathway from the jet so that the drilling mud is directed across the face.

2. The apparatus of claim 1 wherein said cone drill bit comprises:

(a) first and second grooves on said cone surface located so that rotation brings said first and second grooves into alignment with said jet; and (b) nose area located teeth bearing against the face of the well borehole.

3. The apparatus of claim 2 wherein said first and second grooves are segments of circles in cross section shape and connect to said nose area groove.

4. The apparatus of claim 2 wherein said nose area groove is a circular groove.

5. The apparatus of claim 4 wherein said circular groove is axially centered.

6. The apparatus of claim 2 including multiple inserts in multiple rows between the first and second grooves.

7. The apparatus of claim 6 wherein said multiple inserts are blunt load bearing teeth segments.

8. The apparatus of claim 7 including two circular rows of inserts.

9. A one cone drill bit comprising:

(a) a drill bit body having a threaded upper end for connection in a drill string;

(b) said drill bit body extending below the threaded upper end and having a passage therein for mud flow;

(c) at least one mud flow jet installed in said drill bit body and having an opening therein wherein the jet directs a downwardly directed flow of drilling mud utilizing drilling mud which is pumped into a drill string connected to the drill bit and wherein the flow of drilling mud crosses the face of the well borehole being drilled;

(d) a journal extending at an angle from said body;

(e) a single cone mounted for rotation on said journal wherein said cone has a large upper end at the upper end of said journal and a smaller lower end and central lower end nose area;

(f) a cone surface supporting one or more rows of cutting teeth or inserts bearing against the face of the well borehole for extending the well borehole during drilling;

(g) a circular groove axially centered on the nose area at the lower end of said cone wherein said groove rotates in proximity of the flow of drilling mud from said jet so that the groove in the cone clears the mud flow from the jet; and (h) wherein said groove forms a substantially clear pathway away from the face the drilling mud.

10. The apparatus of claim 9 wherein said cone drill bit comprises:

(a) first and second grooves on said cone surface located so that rotation brings said first and second grooves into alignment with said jet; and (b) nose area located teeth bearing against the face of the well borehole.

11. The apparatus of claim 10 wherein said first and second grooves are segments of circles in cross section shape and connect to said nose area groove.

12. The apparatus of claim 10 wherein said nose area groove is a circular groove.

13. The apparatus of claim 12 wherein said circular groove is axially centered.

14. The apparatus of claim 10 including multiple inserts in multiple rows between the first and second grooves.

15. The apparatus of claim 14 wherein said multiple inserts are blunt load bearing teeth segments.

16. The apparatus of claim 15 including two circular rows of inserts.

17. A one cone drill bit comprising:

(a) a drill bit body having a threaded upper end for connection in a drill string;

(b) said drill bit body extending below the threaded upper end and having a passage therein for mud flow;

(c) at least one mud flow jet installed in said drill bit body and having an opening therein wherein the jet directs a downwardly directed flow of drilling mud utilizing drilling mud which is pumped into a drill string connected to the drill bit and wherein the flow of drilling mud flushes cuttings across the face of the well borehole being drilled;

(d) a journal extending at an angle from said body;

(e) a single cone mounted for rotation on said journal wherein said cone has a large upper end at the upper end of said journal and a smaller lower end ending at a nose area;

(f) a cone surface supporting one or more rows of cutting teeth or inserts bearing against the face of the well borehole for extending the well borehole during drilling;

(g) a circular groove formed at the nose area; and (h) wherein said groove rotates with the cone to form a substantially clear pathway for the mud so that the drilling mud flows from said groove and is directed up the well borehole from the groove.

18. The apparatus of claim 17 wherein said cone drill bit comprises:

(a) first and second grooves on said cone surface located so that rotation brings said first and second grooves into alignment with said jet; and (b) nose area located teeth bearing against the face of the well borehole.

19. The apparatus of claim 18 wherein said first and second grooves are segments of circles in cross section shape and connect to said nose area groove.

20. The apparatus of claim 18 wherein said nose area groove is a circular groove of circular cross section.

21. The apparatus of claim 20 including said circular groove is axially centered.

22. The apparatus of claim 18 including multiple inserts in multiple rows between the first and second grooves.

23. The apparatus of claim 22 wherein said multiple inserts are blunt load bearing teeth segments.

24. The apparatus of claim 23 including two circular rows of inserts.

* * * * *